US008006925B2

(12) United States Patent
Liu

(10) Patent No.: US 8,006,925 B2
(45) Date of Patent: Aug. 30, 2011

(54) CONTROL METHOD FOR SUPERFINE POWDER GRINDING INDUSTRIAL WASTE SLAG IN AN ENERGY-SAVING AND ENVIRONMENTAL-FRIENDLY TYPE OF CLOSED CYCLE WITH HIGH YIELD AND THE APPARATUS FOR THE SAME

(75) Inventor: Huaiping Liu, Jiangsu (CN)

(73) Assignee: Jiangsu Kehang Environment Engineering Technology, Jiangsu (CN)

( * ) Notice: Subject to any disclaimer, the term of this patent is extended or adjusted under 35 U.S.C. 154(b) by 227 days.

(21) Appl. No.: 11/996,491

(22) PCT Filed: Dec. 16, 2005

(86) PCT No.: PCT/CN2005/002224

§ 371 (c)(1),
(2), (4) Date: Aug. 28, 2008

(87) PCT Pub. No.: WO2007/009321

PCT Pub. Date: Jan. 25, 2007

(65) Prior Publication Data

US 2009/0101740 A1 Apr. 23, 2009

(30) Foreign Application Priority Data

Jul. 21, 2005 (CN) ..... 2005 1 0041112

(51) Int. Cl.
*B02C 19/00* (2006.01)

(52) U.S. Cl. ..... 241/23; 241/25; 241/29; 241/57; 241/65; 241/101.2

(58) Field of Classification Search ..... 241/23, 241/25, 65, 57, 101.2, 29
See application file for complete search history.

(56) References Cited

U.S. PATENT DOCUMENTS 2,679,726 A * 6/1954 Moncrieff ..... 60/224
(Continued)

FOREIGN PATENT DOCUMENTS

CN 2250807 Y 4/1997
(Continued)

*Primary Examiner* — Mark Rosenbaum
(74) *Attorney, Agent, or Firm* — Seed Intellectual Property Law Group PLLC

(57) ABSTRACT

The present invention provides a control method for superfine powder grinding industrial waste slag in an energy-saving and environmental-friendly type of closed cycle with high yield and the apparatus for the same. The method combines a drying process and a powder grinding process, adopts an in-line monitoring process, automatically adjusts and controls the operating parameters. Therefore, the invention changes the conventional open cycle into a closed cycle, shortens the cycle, achieves the automatic control and adjustment of the operating parameters, and obtains the superfine product with high yield. So the invention enhances the application value of industrial waste slag, extends the applicable field of industrial waste slag, and increases the extra value of final product. The apparatus primarily adds a wind sweeping drying grinder, an in-line laser particle detector, and an automatic control device, furthermore selects a screener and a deduster with high efficiency and product quality and therefore needs less space, investment and energy consumption, improves the work efficiency, the quality of the product and overall efficiency. The apparatus can automatically adjust and control the operating parameters, improve the physical and chemical characteristics of industrial waste slag, and change the industrial waste slag to industrial additive or admixture with good performance; therefore it has good economic and social benefit.

10 Claims, 7 Drawing Sheets

U.S. PATENT DOCUMENTS

| | | | | |
|---|---|---|---|---|
| 5,551,639 | A * | 9/1996 | Artemjev et al. | 241/5 |
| 7,377,955 | B1 * | 5/2008 | Shaw et al. | 75/414 |
| 7,635,100 | B2 * | 12/2009 | Zhang | 241/23 |

FOREIGN PATENT DOCUMENTS

| | | | |
|---|---|---|---|
| CN | 1268407 | A | 10/2000 |
| CN | 2780366 | Y | 4/2005 |
| CN | 2787313 | Y | 4/2005 |
| CN | 2788905 | Y | 4/2005 |
| CN | 2788906 | Y | 4/2005 |
| GB | 783113 | | 9/1957 |
| IE | 960892 | | 7/1997 |
| JP | 6-80447 | * | 3/1964 |
| SU | 1351673 | A1 | 11/1987 |
| WO | 9732073 | A1 | 9/1997 |

* cited by examiner

CONTROL METHOD FOR SUPERFINE POWDER GRINDING INDUSTRIAL WASTE SLAG IN AN ENERGY-SAVING AND ENVIRONMENTAL-FRIENDLY TYPE OF CLOSED CYCLE WITH HIGH YIELD AND THE APPARATUS FOR THE SAME

TECHNICAL FIELD

The present invention relates to a grinding method for industrial waste slag and the apparatus for the same, more particularly, to a superfine and high yield grinding control method for energy-saving and environmental-friendly type of industrial waste slag closed cycle and the apparatus for the same.

BACKGROUND OF INVENTION

The most industrial slag, such as mine scoria, steel slag, coat ash, coat residue, etc. once were buried after compression or sterilization, or simply used as additive. Later on, it has been found that almost aft the industrial waste slag can find its application in architecture. Particularly, through powder grinding process, the industrial waste slag can be used as additive in building mixture material, concrete and the product made of them. The prior art powder grinding process and apparatus for industrial waste slag is as follows: removing the iron from the industrial waste slag by means of iron-removing device; cracking the waste slag by means of a cracking device; transferring the broken waste slag into a hopper by means of a lifting device; transferring the waste slag into the rotary type or vertical type of drying device after metering; drying the waste slag through a hot air furnace, therefore the water contained in the waste slag evaporates into steam, which, together with the smog, flow into a deduster in order to remove the dust; after purifying, the gases are discharged into the atmosphere through a gas guiding device; the collected dust and the dried waste slag are conveyed to a lifting device by a conveyor, and lifted into a storing tank; after re-metering, transferring the waste slag to a ball grinder and powder grinding the waste slag, after grinding, then a fine finished product is obtained; the waste gases produced during powder grinding procedure are discharged into the atmosphere through a air guiding device after being dedusted by a deduster, the collected dust together with the finished product are lifted into the storing tank by a lifting device.

Since the prior process is a open process, it has tong flowing process, it is inconvenient to control and adjust the process, the yield is low, the fineness after powder grinding can not be guaranteed, the apparatus occupy too much space, a separate drying system is needed, the cost of investment is high, the automatic level is low, the energy consumption is high, the working efficiency is low, it only adapts to one single kind of product, the economic benefit is insignificant. Therefore, there are only a few enterprises that manufacture the industrial waste slag grinding.

SUMMARY OF THE INVENTION

The objective of the invention is to provide a control method for superfine powder grinding industrial waste slag in an energy-saving and environmental-friendly type of closed cycle with high yield, so that the disadvantages of the prior art can be overcome or mitigated. This method adopts integrated procedure of air sweeping, drying, and grinding, and also adopts a loop flow powder selecting procedure; in-line monitors the amount of the material which is fed into the grinder and the output material from the grinder, and the particle size of the finished product etc., and optimizes the combination of the operating parameters to achieve the optimal parameters such as rotary speed of the grinder, rotary speed of the powder screening device, air flow rate etc. and to perform an automatic control and adjustment in real time.

The objective of the invention is to provide a control apparatus for superfine powder grinding industrial waste slag in an energy-saving and environmental-friendly type of closed cycle with high yield, so that the disadvantages of the prior art can be overcome or mitigated. This apparatus: combines a drying device and a grinder so as to diminish the occupied land, the investment and the energy consumption, improves the working efficiency; adopts a powder screening device and a deduster with high efficiency so as to improve the quality of the product and the efficiency; adopts a laser particle detector and an automatic detect and control device, so as to automatically adjust and control the operating parameters and achieve high yield, superfine products and change the physical and chemical characteristics, so that the industrial waste slag is changed into an industrial additive or intermingle agent with good performance, therefore, the application value of the waste slag is enhanced and the additional valve is added.

These objects of the invention can be achieved through the following solutions.

According to the invention, there is provided a control method for superfine powder grinding industrial waste slag in an energy-saving and environmental-friendly type of closed cycle with high yield includes removing the iron from the industrial waste slag, cracking and metering the waste slag, characterized in that: after metering the waste slag, a wind sweeping, drying and powder grinding process is carried out, the waste gases from wind sweeping, drying and powder grinding process is dedusted, the purified gases are discharged into the atmosphere, the collected dust and the output material produced by the wind sweeping-drying powder grinding process is detected by the in-line laser particle detector, and then the screening process is carried out; after being detected by the in-line laser particle detector, the screened out fine powder is obtained as a finished product, the rough powder and newly added material continue to be ground; the operating parameters are automatically controlled and adjusted based on the in-line detecting result.

Preferably, when the particle size of the output material is more than 30 μm, the rotary speed for powder screening is increased by 10-20%; or the input amount for wind sweeping-drying powder grinding is decreased by 8-12%.

Preferably, when the particle size of the output material is less than 20 μm, the airflow for dedusting after wind sweeping, drying and powder grinding process is increased by 8-12%; or the input amount for wind sweeping, drying, and powder grinding process is increased by 8-12%.

Preferably, when the particle size of the finished product is more than 10 μm, the rotary speed for screening is increased by 15-25%; when the particle size of finished product is less than 5 μm, the rotary speed for screening is decreased by 8-12%, and the air flowrate for dedusting the waste gases from the wind sweeping, drying and powder grinding process is increased by 8-12%.

According to the invention, there is also provided a control apparatus for superfine powder grinding industrial waste slag in an energy-saving and environmental-friendly type of closed cycle with high yield includes: cracking device, metering device for input material, sprayer of the grinded coat powder, flame sprayer, mixing combustion chamber, lifting device, powder screening device, deduster, wind guiding device, storing tank for finished product, characterized in that it further includes: wind sweeping-drying grinder, laser particle detector, automatic control device; two laser particle size detectors are installed at the output port of the wind sweeping-drying powder grinder and the fine powder output port of the powder screening device respectively, and connected with the automatic control apparatus which in turn is connected with the metering device for input material, the powder screening device, and the deduster.

Preferably, the back portion of powder grinder house of the wind sweeping-drying powder grinder is divided into a first powder grinder house and a second powder grinder house by a screening partition board; the front portion of the powder grinder house is divided by a drying house partition board so as to provide a drying house therein, a cylindrical material-flying board is provided within the drying house, several rectangular material-flying ribs are evenly provided on the inner watt of the cylindrical material-flying board, on the two sides of the material-flying ribs there are provided triangular enforcing boards.

Preferably, said drying house partition board comprises drying house partition board body, a fixing ring, a stop ring, a material-flying ring, an enforcing ring, an wave type of arcuate material-flying board; the fixing ring is provided in the middle of the inner watt of the cylindrical partition board body, the stop ring and the fixing ring are concentrically provided on the same diameter plane, and connected with each other by means of several wave type of arcuate material-flying board which are evenly distributed, the material-flying ring is provided on the inner end port of the cylindrical partition board body, the enforcing ring and the material-flying ring are provided on the same diameter plane, the enforcing ring is connected with the tail of the wave type of arcuate material-flying board.

Preferably, two to four spaced tilt guiding boards are provided in the middle of the material input port of the head of the wind sweeping-drying powder grinder, so that the material flows into the grinder from between the guiding boards, and the hot air flows into the grinder from its two sides.

Preferably, said deduster is an anti-dew bag type deduster which comprises a divisional chamber pulse sprayer and an input gas flow homogenization mechanism and an overflow type of locking wind twist knife.

Preferably, said powder screening device is a wind circulation powder screen device which comprises an air allocating chamber, a cage rotor, a material scattering disc, an air input pipe, a dispersed pre-grading chamber, a tangent air pipe, an air input ring pipe, an air transferring pipe, an adjusting air valve, an air guiding assembly.

The invention can achieve the following technical effects. Because the invention adopts a closed cycle, the entire process is shortened, the operating parameters can be automatically controlled and adjusted, the high yield and superfine product can be obtained, the application value of the industrial waste slag is enhanced, the applicable field of the industrial slag is broadened, and the added value of the product is increased. In addition, the apparatus is of high efficiency and energy saving, it occupies less land space, involves less investment and has a high degree of automation, the energy consumption is effectively decreased, the second pollution can be eliminated, and the working efficiency can be improved. Therefore, the invention can achieve economic and social benefits.

Figure 1:
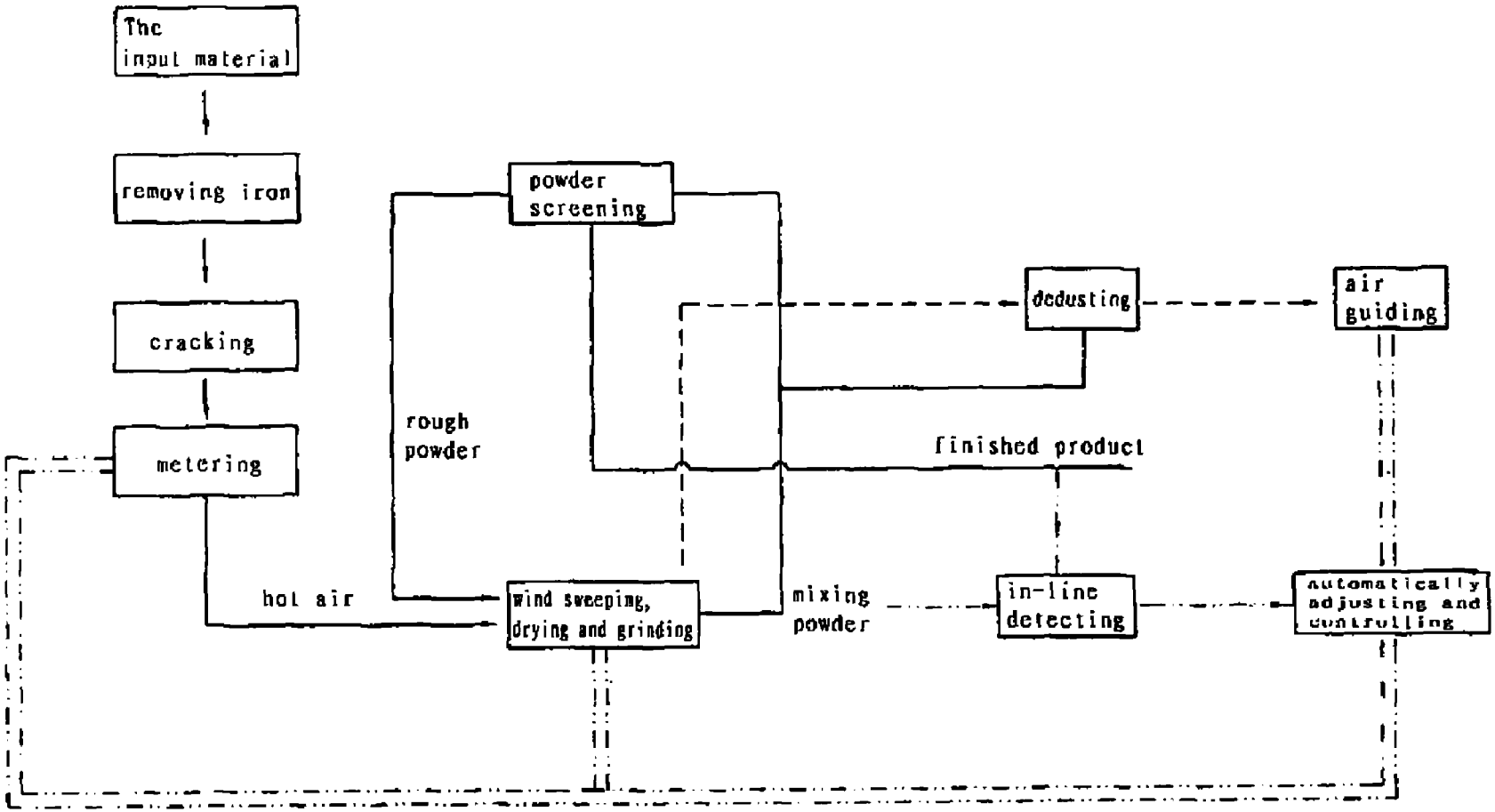
FIG. 1 is a flowing chart of the embodiment of the invention.
Figure 2:
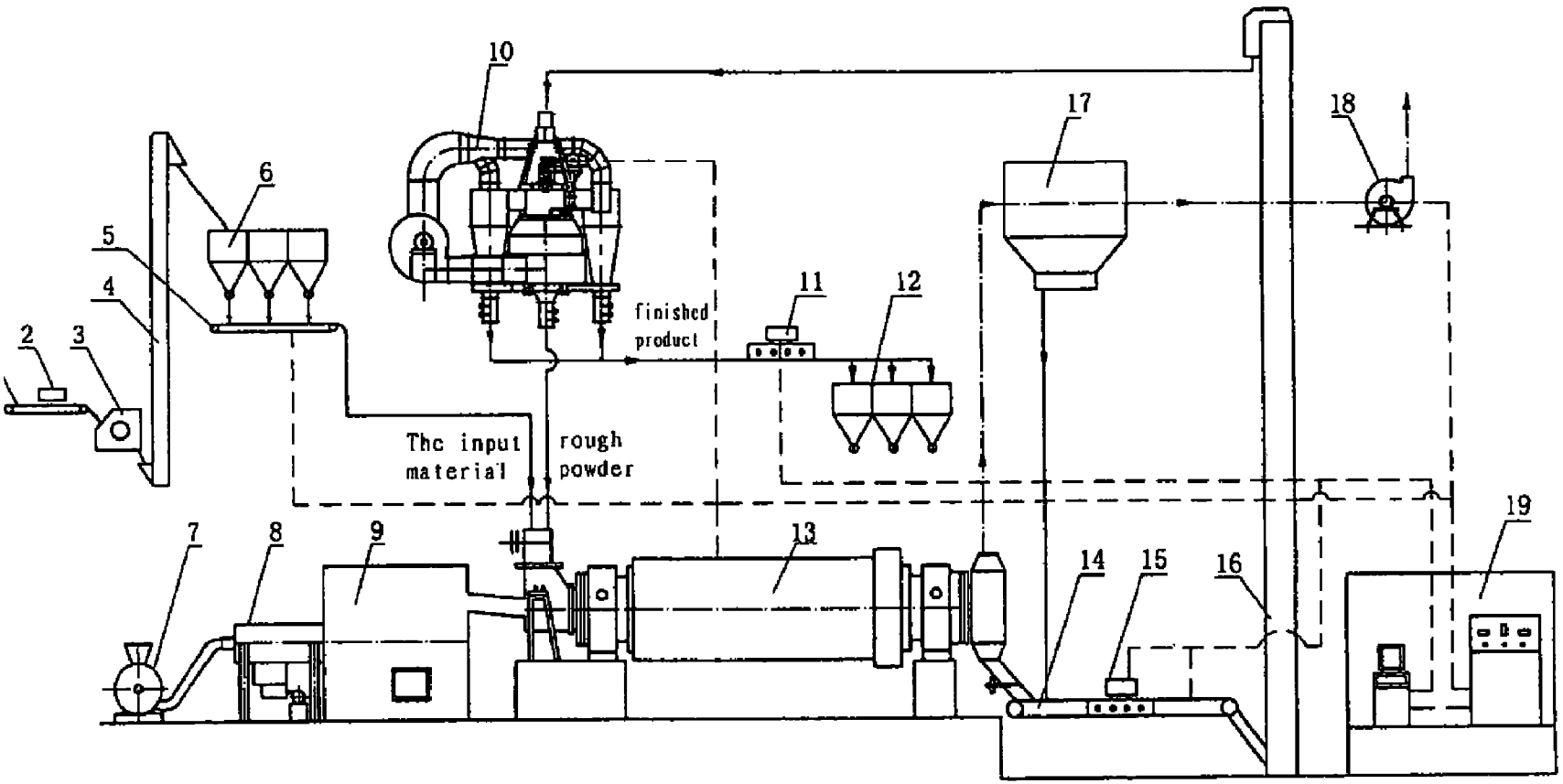
FIG. 2 is a schematic view of the apparatus of the invention.
Figure 3:
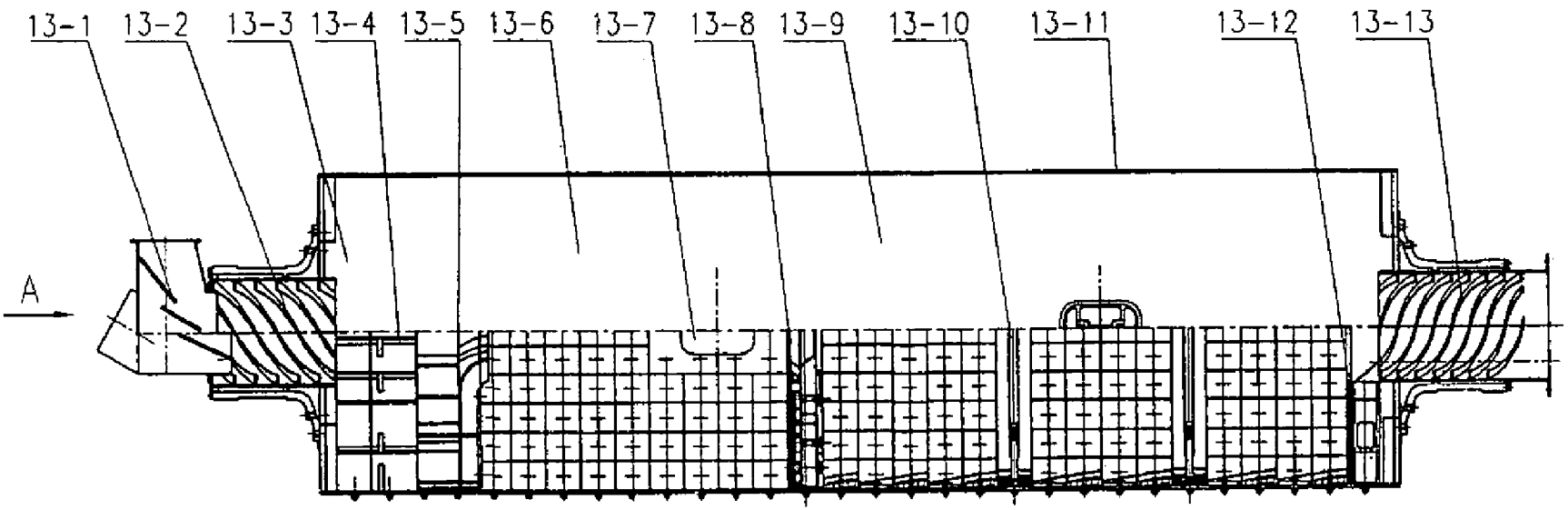
FIG. 3 is schematic view illustrating the structure of the embodiment of the wind sweeping-drying powder grinder.
Figure 4:
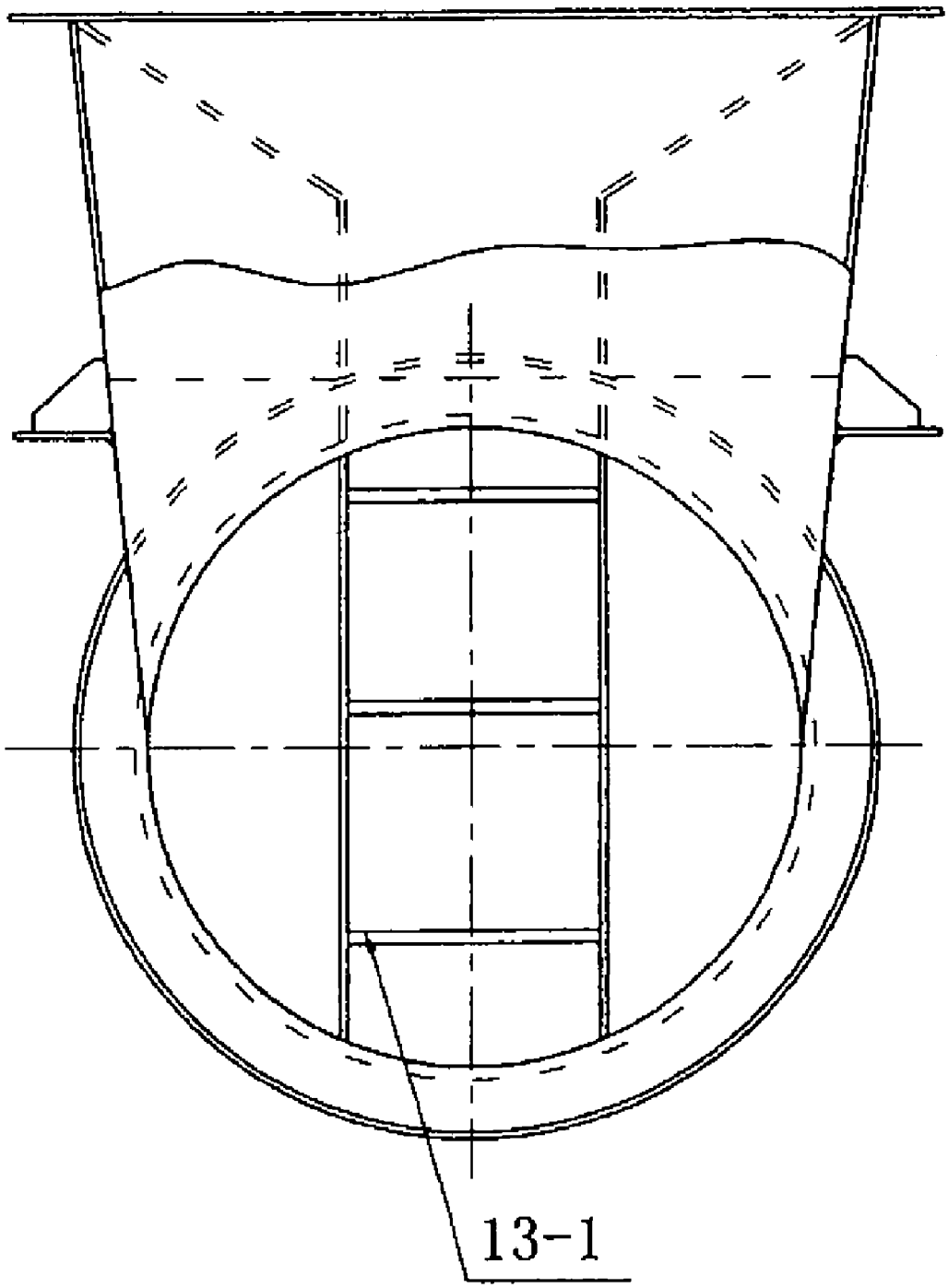
FIG. 4 is an enlargement partial view along the direction A in FIG. 3.
Figure 5:
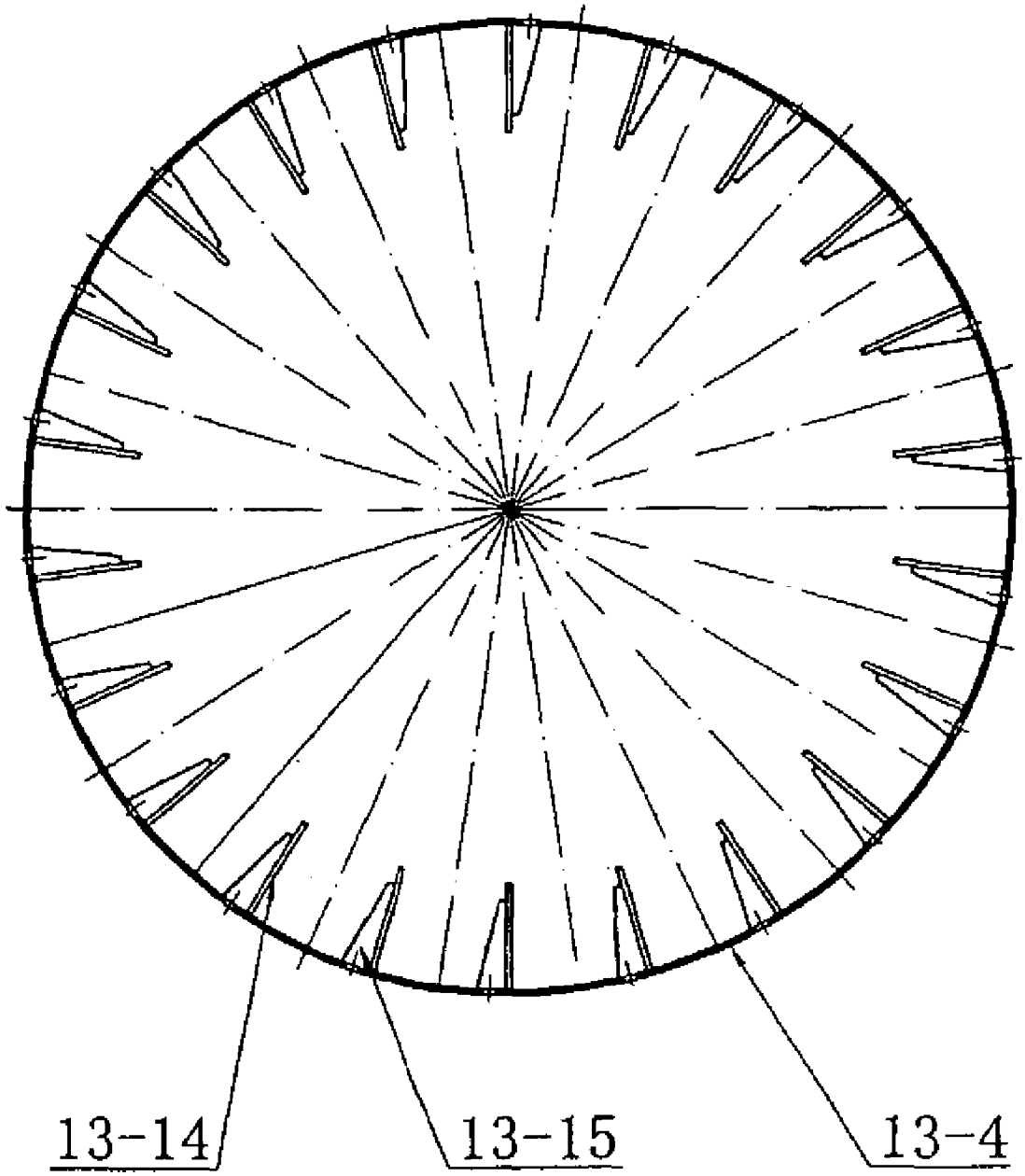
FIG. 5 is a schematic view illustrating the structure of the material-flying board of the wind sweeping-drying powder grinder.
Figure 6:
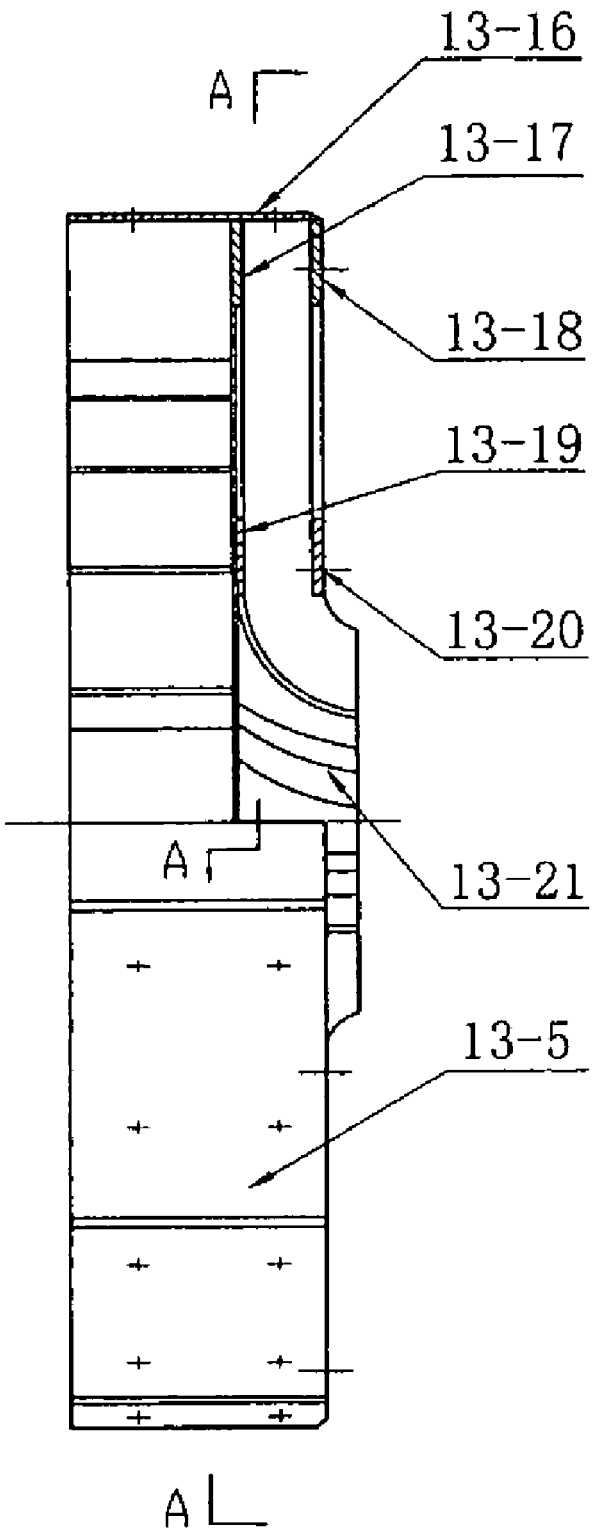
FIG. 6 is a schematic view of the drying house partition board of the wind sweeping-drying-powder grinder.
Figure 7:
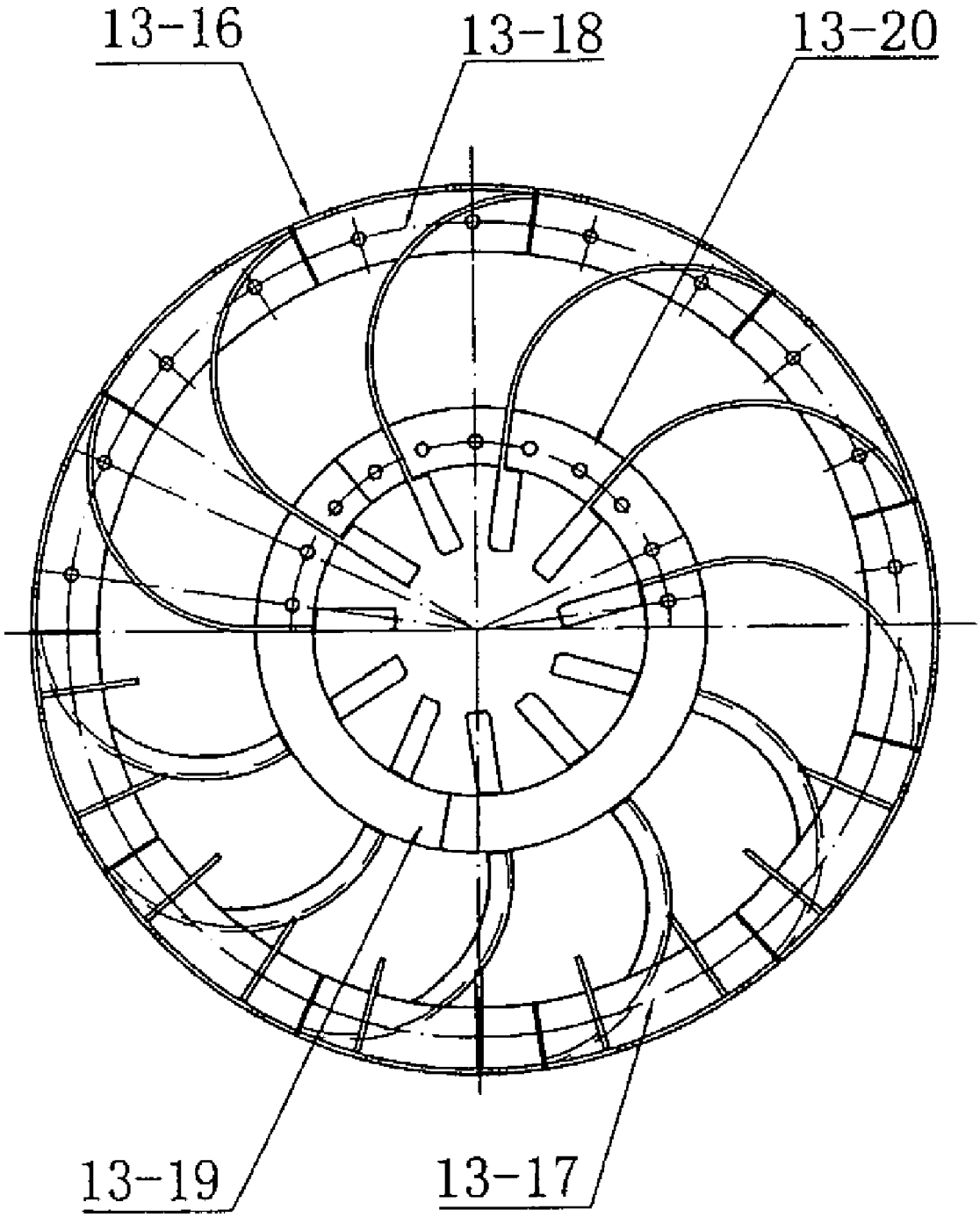
FIG. 7 is a sectional view along the line A-A in FIG. 6.

In the drawings, the solid arrows denote the flowing direction of the material. The dotted arrows denote the flowing direction of the gas. The single dotted arrows denote the transporting direction of the detecting signals. The double dotted arrows denote the transporting direction of the control signals.

The fist of the reference numerals is as follows:

1 material input belt conveyor
2 iron-removing device
3 cracking device
4 lifting device
5 metering device for input material
6 hopper
7 sprayer of grinded coat powder
8 flame sprayer
9 mixing combustion chamber
10 powder screening device
11 laser particle detector
12 finished product storing tank
13 wind sweeping-drying powder grinder
14 metering balance
15 laser particle detector
16 lifting device
17 deduster
18 wind guiding device
19 automatic control device
13-1 guiding board
13-2 input material spiral conveyor
13-3 drying house
13-4 material-flying board
13-5 drying house partition board
13-6 the first powder grinder house
13-7 grinder door
13-8 screening partition board
13-9 the second powder grinder house
13-10 activating stop ring
13-11 grinder body
13-12 material output device
13-13 output material spiral conveyor
13-14 material-flying rib
13-15 enforcing board
13-16 drying house partition board body
13-17 fixing ring
13-18 material-flying ring
13-19 stop ring
13-20 enforcing ring
13-21 wave type of arcuate material-flying board

THE DESCRIPTION OF EMBODIMENTS OF INVENTION

The embodiment of the invention will be described in more detail with reference to the drawings.

According to an example of the invention, the industrial waste slag can be produced into the superfine powder as mixing materials in the architecture. According to the invention, a control method for superfine powder grinding industrial waste slag in an energy-saving and environmental-friendly type of closed cycle with high yield is as follows: removing the iron from the industrial waste slag; cracking the waste slag; wind sweeping, drying, and powder grinding the waste slag after metering; dedusting the waste gases caused by the wind sweeping, drying and powder grinding; discharging the purified gases into the atmosphere; detecting in-line the collected dust and the output material from the powder grinder after wind sweeping, drying, and powder grinding by the laser; then screening them; the fine powder which is screened out is the finished product, the finished products are put into storing bank after being in-line detected by the laser, the rough powder together with newly added material are continued to be ground; according to the in-line detecting result, the operating parameters are automatically adjusted and controlled.

The operating parameters of the method can be adjusted and controlled in such a way: when the particle size of the output material from the powder grinder is greater than 30 μm, the rotary speed for powder screening is increased by 10-20%; or the input amount for wind sweeping, drying and powder grinding is decreased by 8-12%. When the particle size of the output material from the powder grinder is smatter than 20 μm, the airflow for dedusting the waste gases after wind sweeping, drying and powder grinding is increased by 8-12%; or the input amount for wind sweeping, drying and powder grinding is increased by 8-12%. When the particle size of the finished product is greater than 10 μm, the rotary speed for powder screening is increased by 15-25%; otherwise, when the particle size of finished product is less than 5 μm, the rotary speed for screening is decreased by 8-12%, and the airflow for dedusting the waste gases after wind sweeping, drying and powder grinding is increased by 8-12%.

According to the invention, a control apparatus for superfine powder grinding industrial waste slag in an energy-saving and environmental-friendly type of closed cycle with high yield includes: material input belt conveyor 1, iron-removing device 2, cracking device 3, metering device for input material 5, hopper 6, sprayer of the grinded coat powder 7, flame sprayer 8, mixing combustion chamber 9, wind sweeping-drying powder grinder 13, metering balance 14, lifting devices 4 and 16, powder screening device 10, deduster 17, wind guiding device 18, storing tank for finished product 12, laser particle detectors 11 and 15, automatic control device 19; two laser particle size detectors 15 and 11 are installed at the output port of the wind sweeping-drying powder grinder 13 and the fine powder output port of the powder screening device 10 respectively, and are connected with the automatic control device 19, which in turn is connected with the metering device for input material 5, the powder screening device 10, and the deduster 17.

Said wind sweeping-drying powder grinder 13 comprises grinder body 13-11, screening partition board 13-8, input material spiral conveyor 13-2, output material spiral conveyor 13-13, material output device 13-12, grinder door 13-7, activating stop ring 13-10, drying house partition board 13-5, material-flying board 13-4, and guiding board 13-1; the input material spiral conveyor 13-2 and the output material spiral conveyor 13-13 are provided on the head and the tail of the grinder body 13-11 respectively, the material output device 13-12 is provided in front of the output spiral conveyor 13-13; the inner chamber of the grinder, i.e. the grinder house, is divided at its back portion, into a first powder grinder house 13-6 and a second powder grinder house 13-9; the grinder door 13-7 is provided on the grinder body of the first powder grinder house 13-6 and the second powder grinder house 13-9 so as to facilitate the installation and maintenance; two (possible one or three) activating stop rings 13-10 are evenly provided within the second powder grinder house 13-9 so as to guarantee the stay period of the material within the grinder, improve the powder grinding efficiency, increase the output of fine powder. The front portion of the grinder house is partitioned by drying house partition board 13-5 so that a drying house 13-3 is formed. A cylindrical material-flying board 13-4 is provided in the drying house 13-3, and can be rotated synchronously with the grinder. Twenty two rectangular material-flying ribs 13-14 are evenly provided on the inner watt of the cylindrical material-flying board 13-4. On the two sides of the material-flying ribs 13-14 there are provided triangular enforcing boards 13-15. The material-flying board 13-4 can not only disperse the material with high water content throughout the entire space of the drying house 13-3, but also crack and scatter the material simply, therefore, the wind sweeping-drying efficiency is improved effectively.

The above mentioned drying house partition board 13-5 comprises a drying house partition board body 13-16, a fixing ring 13-17, a stop ring 13-19, a material-flying ring 13-18, an enforcing ring 13-20, a wave type of arcuate material-flying board 13-21. The fixing ring 13-17 is provided in the middle of the inner watt of the cylindrical drying house partition board body 13-16. The stop ring 13-19 and the fixing ring 13-17 are provided concentrically on the same diameter plane, and connected with each other by means of several wave type of arcuate material-flying boards 13-21 which are evenly distributed. The material-flying ring 13-18 is provided on the inner end port of the cylindrical drying house partition board body 13-16. The enforcing ring 13-20 and the material-flying ring 13-18 are provided on the same diameter plane. The enforcing ring 13-20 is connected with the tail end of the wave type of arcuate material-flying board 13-21. This kind of dying house partition board 13-5 has a big area for material passage, the area is more than 40% of the section area of the grinder, the resistance of the material and gases is low, the passage capability of the material is high, the material transferred to the drying house partition board 13-5 can be forced into the first powder grinder house 13-6, and it is assured that the steel balls in the house can not be returned into the drying house 13-3.

Three spaced tilt guiding boards 13-1 are provided in the middle of the material input port of the head of the wind sweeping-drying powder grinder 13, and constitute a separation mechanism for the material and gases. Thus, the material flows into the grinder from between the guiding boards 13-1, and the hot air flows into the grinder from two sides of the guiding board 13-1. In this way, it is assured that not only the material can easily enter into grinder, but also the resistance of the hot gases is decreased, therefore it meets the need of high flowrate of the wind sweeping-drying grinder 13.

Using the wind sweeping-drying grinder 13, the drying process and the powder grinding process of the material are accomplished at one time, therefore, the investment of the apparatus is decreased, and the energy consumption is also decreased. During the drying and the powder grinding process, through the forced ventilation within the grinder, the material is rapidly interchanged with the hot gases so as to be dried rapidly. The steam resulted from drying process and the grinded fine powder can be drawn out in time through the wind guiding device 18 which is connected with the grinder tail, this accelerates the flow of material within the grinder, therefore the phenomena of over-grinding and micro-over-grinding of the material can be avoided completely, and the powder grinding efficiency is improved dramatically. When the water content of the material is less than 1.5%, the dying house 13-3 can be stopped, i.e. stopping the supply of the hot gases, therefore the energy consumption can be further decreased. When water content of the material is more than 8%, the drying house can not meet the need of the production, so that a separate drying apparatus must be equipped.

Said deduster 17 is an anti-dew bag type deduster which comprises a divisional chamber pulse sprayer and an input gas flow homogenization mechanism and an overflow type locking wind twist knife. The filtering speed of the deduster is high, and it would not produce the secondary flying dust. The deduster can handle the dust of high concentration, the discharging concentration standard is superior to the regulated discharging standard; furthermore, it can increase the air flowrate for handling, and has a pressure difference dedusting function. Therefore, the times of dedusting and the compressed air consumption can be decreased, the system can be operated stably, the service fife of the filtering bag can be prolonged, and the maintenance cost is low. In addition, the leaking airflow can also be decreased; this facilitates to prevent the filtering bag form dewing.

Said powder screening device 10 is a wind circulation powder screening device which comprises an air allocating chamber, a cage rotor, a material scattering disc, an air input pipe, a dispersed pre-grading chamber, a tangent air pipe, an air input ring pipe, an air transferring pipe, an adjusting air valve, an air guiding assembly. The powder screening device 10 is manufactured according to the technology disclosed in the present applicant's Chinese patent application Nos. 200520070483.9, 200520070484.3, 200520070485.8, 200520070486.2. It employs the advanced planar vortex powder screening principle, and employs in combination of the suspending dispersing technology, pre-grading technology, inner circulation collecting technology, purified gases decreasing temperature technology, this results in a high efficiency of powder screening. At the same time, through the use of the inner circulation, self-collecting manner, it overcomes the disadvantage of the high investment and the high operation cost, it has much more handling capability, higher screening efficiency than the traditional powder screening device. The powder screening efficiency can be improved by about 25%.

The automatic control device 19 receives the detecting result of the grinded material and fine power by the in-line laser particle detector 11 and 15, and computes and analyzes the parameters including the water content of the material entering the wind sweeping-drying grinder 13, the amount of the material, the rotary speed of the powder screening device 10, the rotary speed of deduster 17 and the air flowrate, etc. so as to ensure an optimal combination of the operating parameters, therefore, the high yield and superfine product.

The working flow of the embodiment of the invention is as follows. The industrial waste slag is transferred through the input material conveyor 1. The iron-removing device 2 removes the iron form the waste slag, the cracking device 3 cracks the waste slag, and then the material is lifted to the hopper 6. The waste slag is metered by the input material metering device 5, then fed into the wind sweeping-drying grinder 13. The hot air with a temperature about 400° C., provided by the sprayer of grinded coat powder 7, flame sprayer 8, and the mixing combustion chamber 9, enters the wind sweeping-drying grinder 13. The material is subject to both the wind sweeping-drying process and the power grinding process. The water content in the material is evaporated. The steam and the waste gases produced by the powder grinding process are draw out by the guiding device 18 from the tail of the wind sweeping-drying grinder 13, and enter the anti-dewing bag type deduster 17. The gases, after being purified by the anti-dewing bag deduster 17, are discharged into the atmosphere through the guiding device 18, the collected dust is transferred back to the tail of the wind sweeping-drying grinder 13, and falls onto the metering balance 14 together with the output material, and is detected by the in-line laser particle detector 15, then is lifted into the wind circulation powder screening device 10 for screening. The screened out rough powder is transferred back to the head of the grinder, and enters the wind sweeping-drying grinder 13 together with the newly added material and continues to be ground. The screened out fine powder, i.e. the finished product, is detected by the in-line laser particle detector 11, then transferred into the finished product storing tank 12, ready for sending out from the plant. The automatic control and detecting device 19 receives the result from the laser particle detector 11 and 15, and can automatically adjust and control the parameters including water content of the material entering the wind sweeping-drying grinder 13, the amount of the material, the rotary speed of the powder screening device 10, rotary speed and the air flowrate of the deduster 17 etc. through the computer analysis.

When the particle size of the output material from the grinder is more than 30 μm, the rotary speed for powder screening is increased by 15%, i.e. the rotary speed of the powder screening device 10 is increased to 140 rpm from 120 rpm by the automatic control device 19. it is also possible to decrease the amount of the material input into the wind sweeping-drying grinder 13 by 10%, i.e. the input amount of the material can be decreased by 10% through adjusting the metering device 5 for input material of the head of the wind sweeping-drying grinder 13 by the automatic control device 19.

When the particle size of the output material from the grinder is less than 20 μm, the air flowrate for dedusting the waste gases of the wind sweeping-drying powder grinder 13 is increased by 10%, i.e. the air flowrate for dedusting of the anti-dewing bag type deduster 17 is increased by 10% through the automatic control device 19. It is also possible to increase the amount of the material feeding into the wind sweeping-drying grinder 13 by 10%, i.e. through adjusting the metering device 5 for input material of the head of the wind sweeping-drying grinder by the automatic control device 19, the input amount is increased by 10%.

When the particle size of the finished product is more than 10 μm, the rotary speed for powder screening is increased by 25%, i.e. the rotary speed of the wind circulation powder screening device 10 is increased to 150 rpm from 120 rpm by means of the automatic control device 19. On the contrary, when the particle size of finished product is less than 5 μm, the rotary speed for screening is decreased by 10%, that is, from 120 rpm to 108 rpm, and the air flowrate of the deduster 17 is increased by 10%.

The invention claimed is:

1. A control method for superfine powder grinding industrial waste slag in an energy-saving and environmental-friendly type of closed cycle with high yield, the method comprising:

removing the iron from the industrial waste slag;

cracking and metering the waste slag;

after metering the waste slag, performing a wind sweeping, drying and powder grinding process;

de-dusting the waste gases from the wind sweeping, drying and powder grinding process;

discharging the purified gases into the atmosphere;

detecting collected dust and output material produced by the wind sweeping, drying and powder grinding process using an in-line laser particle detector;

performing a screening process after detecting the collected dust and the output material such that screened out fine powder is obtained as a final product;

continuing to grind both rough powder and newly added material; and automatically controlling and adjusting operating parameters based on an in-line detecting result.

2. The control method according to claim 1, wherein when the particle size of the output material is more than 30 μm, the rotary speed for powder screening is increased by 10-20%; or the input amount for the wind sweeping, drying and powder grinding is decreased by 8-12%.

3. The control method according to claim 1, wherein when the particle size of the output material is less than 20 μm, the airflow for dedusting the waste gases after the wind sweeping, drying and powder grinding process is increased by 8-12%; or the input amount for the wind sweeping, drying and powder grinding is increased by 8-12%.

4. The control method according to claim 1, wherein when the particle size of the finished product is more than 10 μm, the rotary speed for screening is increased by 15-25%; when the particle size of finished product is less than 5 μm, the rotary speed for screening is decreased by 8-12%, and the air flow rate for dedusting the waste gases from the wind sweeping, drying and powder grinding process is increased by 8-12%.

5. A slag processing apparatus for superfine powder grinding industrial waste slag in an energy-saving and environmental-friendly type of closed cycle with high yield, the slag processing apparatus comprising a cracking device, a metering device for input material, a sprayer of grinded coal powder, a flame sprayer, a mixing combustion chamber, a lifting device, a powder screening device, a deduster, a wind guiding device, a storing tank for finished product, a wind sweeping-drying powder grinder, an automatic control device, two particle size detectors installed at an output port of the wind sweeping-drying powder grinder and a fine powder output port of the powder screening device respectively, and connected with the automatic control device which in turn is connected with the metering device for input material, the powder screening device, and the deduster.

6. The slag processing apparatus according to claim 5, wherein a back portion of a powder grinder house of the wind sweeping-drying powder grinder is divided into a first powder grinder house and a second powder grinder house by a screening partition board; a front portion of the powder grinder house is divided by a drying house partition board so as to provide a drying house therein, a cylindrical material-flying board is provided within the drying house, several rectangular material-flying ribs are evenly provided on the inner wall of the cylindrical material-flying board, on the two sides of the material-flying ribs there are provided triangular enforcing boards.

7. The slag processing apparatus according to claim 6, wherein said drying house partition board comprises a drying house partition board body, a fixing ring, a stop ring, a material-flying ring, an enforcing ring, and a wave type of arcuate material-flying board; wherein the fixing ring is provided in the middle of the inner wall of the cylindrical partition board body, the stop ring and the fixing ring are concentrically provided on the same diameter plane, and connected with each other by several wave type of arcuate material-flying board which are evenly distributed, the material-flying ring is provided on the inner end port of the cylindrical partition board body, the enforcing ring and the material-flying ring are provided on the same diameter plane, the enforcing ring is connected with the tail of the wave type of arcuate material-flying board.

8. The slag processing apparatus according to claim 6, wherein two to four spaced tilt guiding boards are provided in the middle of the material input port of the head of the wind sweeping-drying powder grinder, so that the material flows into the grinder from between the guiding boards, and the hot air flows into the grinder from its two sides.

9. The slag processing apparatus according to claim 5, wherein said deduster is an anti-dew bag type deduster which comprises a divisional chamber pulse sprayer and an input gas flow homogenization mechanism and an overflow type of locking wind twist knife.

10. The slag processing apparatus according to claim 5, wherein said powder screening device is a wind circulation powder screen device which comprises an air allocating chamber, a cage rotor, a material scattering disc, an air input pipe, a dispersed pre-grading chamber, a tangent air pipe, an air input ring pipe, an air transferring pipe, an adjusting air valve, and an air guiding assembly.

* * * * *